US011559822B2

(12) United States Patent
Jung

(10) Patent No.: US 11,559,822 B2
(45) Date of Patent: Jan. 24, 2023

(54) COSMETIC CONTAINER HAVING RETRACTABLE BUTTON

(71) Applicant: YONWOO CO., LTD., Incheon (KR)

(72) Inventor: Seo Hui Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 17/421,044

(22) PCT Filed: Dec. 19, 2019

(86) PCT No.: PCT/KR2019/018080
§ 371 (c)(1),
(2) Date: Jul. 7, 2021

(87) PCT Pub. No.: WO2020/145543
PCT Pub. Date: Jul. 16, 2020

(65) Prior Publication Data

US 2022/0097089 A1 Mar. 31, 2022

(30) Foreign Application Priority Data

Jan. 7, 2019 (KR) ..... 10-2019-0001679

(51) Int. Cl.
*B05B 11/00* (2006.01)
*A45D 34/04* (2006.01)
*A45D 40/26* (2006.01)

(52) U.S. Cl.
CPC ..... *B05B 11/3007* (2013.01); *A45D 34/04* (2013.01); *A45D 40/26* (2013.01); *B05B 11/3052* (2013.01); *A45D 2200/056* (2013.01)

(58) Field of Classification Search
CPC ..... B05B 11/3007; B05B 11/3052; B05B 11/3059; B05B 11/0032; B05B 11/306; B05B 11/3001; A45D 34/04; A45D 40/26; A45D 2200/056; B65D 33/1666; B65D 83/00; B65D 2231/005
See application file for complete search history.

(56) References Cited

U.S. PATENT DOCUMENTS 5,549,223 A * 8/1996 Hori ..... B05B 11/3001 222/321.9

FOREIGN PATENT DOCUMENTS

| | | |
|---|---|---|
| KR | 20-0347811 Y1 | 4/2004 |
| KR | 10-1267966 B1 | 5/2013 |
| KR | 10-1388094 B1 | 4/2014 |

(Continued)

*Primary Examiner* — Donnell A Long
(74) *Attorney, Agent, or Firm* — Bridgeway IP Law Group, PLLC; Sang Ho Lee; Hyun Woo Shin

(57) ABSTRACT

Provided is a cosmetic container having a retractable button including: a container body filled with contents; a pump part arranged on the upper portion of the container body in order to discharge the contents externally through a pumping action; and a button part arranged on the upper portion of the pump part to make the pumping action carried out by the user's pressing and releasing action, the button part having a discharge part to discharge the contents externally, wherein the button part has an inhalation space formed inside the button part, and the inhalation space is communicated with the discharge part, is increased or decreased in volume according to pressurization and release of the button part in order to inhale the contents remaining in the discharge part.

20 Claims, 9 Drawing Sheets

(56) References Cited

FOREIGN PATENT DOCUMENTS

| | | | | | |
|---|---|---|---|---|---|
| KR | 10-1666683 | B1 | | 10/2016 | |
| KR | 101666683 | B1 | * | 10/2016 | ..... B65D 47/00 |
| KR | 10-1722531 | B1 | | 4/2017 | |
| KR | 101722531 | B1 | * | 4/2017 | ..... B65D 47/00 |
| KR | 10-2018-0110982 | A | | 10/2018 | |

* cited by examiner

COSMETIC CONTAINER HAVING RETRACTABLE BUTTON

TECHNICAL FIELD

The present invention relates to a cosmetic container having a retractable button, and more particularly, to a cosmetic container having a retractable button, which can elevate and lower a button by rotation of a rotary cap and discharge contents by the button being pressed in a state where the button is elevated.

BACKGROUND ART

In general, a dispenser type container has a dispenser coupled to the upper side of an airtight container filled with gas, liquid or other contents, and jets out a certain amount of contents. The dispenser type container is applied to various airtight containers to store cosmetics, perfume, medicines or food.

The conventional dispenser type container includes a container body in which the contents are contained, a pump coupled to the upper portion of the container body to pull up the contents from the inside of the container body, which is in a vacuum condition, by a pumping action, and a button located at the upper portion of the pump and elevated and lowered according to a user's pressing action in order to transfer pressure to the pump. When the user presses the button, the contents is discharged out by the pumping action of the pump. However, the conventional dispenser type container has a disadvantage in that pressure is unintendedly applied to the button and the contents are discharged out unnecessarily while the user carries the container.

In order to overcome the disadvantage of the conventional dispenser type container, Korean Utility Model Registration No. 20-0347811 (hereinafter, called 'patent literature 1') discloses a 'retractable cosmetic container' having a button which is exposed externally just when a user wants to use the contents.

Referring to the patent literature 1, the retractable cosmetic container includes: a container for discharging the contents stored in the container when a user presses a button; an outer container located outside the container; a pump body located in a guide hole of the outer container and having a guide protrusion; and a button mounted on the pump body to go into and out of a rotating tube body while the guide protrusion is guided along a spiral hole of the rotating tube body. A guide tube body having spiral holes bidirectionally on the upper portion of the outer container is mounted by undercut, and the guide protrusion formed in the pump body is coupled to the spiral hole of the guide tube body. The rotary tube body which has vertical guide grooves formed at both sides of the inside thereof is covered on the outer surface of the guide tube body and is mounted by undercut, the end of the guide protrusion of the pump body penetrating the spiral hole of the guide tube body is located at the vertical guide groove, and the button is mounted on a stem of the pump body.

Because such a conventional cosmetic container having a retractable button according to the patent literature 1 has several disadvantages in that the unit price of products rises due to a double container structure since having the structure that the container accommodated in the outer container is elevated and lowered together with the button while the button is elevated and lowered, and in that the container may be separated or defective products may be made due to weight of the container in which the contents are contained if a user drops the container from carelessness in the state where the container is elevated.

Moreover, the convention cosmetic container has other disadvantages in that it may cause pollution of the container since the contents remain at the front end of a nozzle of the button and the contents remaining at the front end of the nozzle leak out or run down after the user presses the button to discharge the contents externally, in that the contents may be deteriorated due to contact with air, and in that the contents are not discharged smoothly since the contents hardened after remaining at the front end of the nozzle block the nozzle.

Therefore, in order to the above-mentioned problems, a cosmetic container having a retractable button is required.

DISCLOSURE

Technical Problem

Accordingly, the present invention has been made in an effort to solve the above-mentioned problems occurring in the prior arts, and it is an object of the present invention to provide a cosmetic container having a retractable button, which can elevate and lower a button by rotation of a rotary cap and discharge contents by the button being pressed in a state where the button is elevated, and which has an inhalation space to inhale the contents after the contents are discharged so as to prevent a leakage of the contents.

Technical objects to be achieved by the present invention are not limited to the above-described objects and other technical objects that have not been described will be evidently understood by those skilled in the art from the following description.

Technical Solution

To achieve the above objects, the present invention provides a cosmetic container having a retractable button including: a container body filled with contents; a pump part arranged on the upper portion of the container body in order to discharge the contents externally through a pumping action; and a button part arranged on the upper portion of the pump part to make the pumping action carried out by the user's pressing and releasing action, the button part having a discharge part to discharge the contents externally, wherein the button part has an inhalation space formed inside the button part, and the inhalation space is communicated with the discharge part, is increased or decreased in volume according to pressurization and release of the button part in order to inhale the contents remaining in the discharge part.

Moreover, preferably, the button part includes: a cap part which is pressed or released by a user and has a discharge part formed at one side; a pressing part which is arranged inside the cap part to transfer pressure generated by the cap part being pressed to the pump part and has a content moving hole formed to allow movement of the contents; and an elastic part arranged between the cap part and the pressing part to generate elastic force toward the cap part, wherein the inner upper surface of the cap part and the upper surface of the pressing part are spaced apart from each other at a predetermined interval by elastic force of the elastic part, and a space formed between the cap part and the pressing part is communicated with the content moving hole, so that the inhalation space is formed.

Furthermore, preferably, at least one retaining groove is formed in the outer circumferential surface of the cap part to a predetermined height, and at least one retaining protrusion is formed on the outer circumferential surface of the pressing part and is inserted into the retaining groove. The retaining protrusion of the pressing part is vertically and relatively moved inside the retaining groove according to pressurization and release of the cap part, and the vertical movement distance is limited by the retaining groove, so that the volume of the inhalation space is changed within a limited range.

Additionally, preferably, at least one guide protrusion protrudes from the outer circumferential surface of the pressing part The cosmetic container includes: a rotating part which is coupled to the upper portion of the container body to be relatively rotated and rotates together with the pressing part by receiving rotary power from the user; an elevation guide part which is arranged inside the rotating part and has a guide groove formed in the outer circumferential surface, the guide protrusion of the pressing art being inserted into the guide groove so that the elevation guide part guides elevation and lowering of the button part according to rotation of the rotating part; and a pumping guide part coupled with the pressing part to rotate together with the pressing part or rotate relative to the pressing part, receiving pressure of the cap part through the guide protrusion and transferring the pressure to the pump part. According to rotation of the rotating part, the cosmetic container is changed into the first state where the button part is lowered down and the discharge part is accommodated in the rotating part or into the second state where the button part is elevated and the discharge part is exposed out of the rotating part.

Moreover, preferably, the guide groove includes an inclined guide groove and a vertical guide groove extending downwards from an end portion of the inclined guide groove. When the rotating part is rotated, the guide protrusion moves along the inclined guide groove to guide elevation and lowering of the pressing part. When the guide groove moves along the inclined guide groove and is located above the vertical guide groove, the guide protrusion vertically moves along the vertical guide groove to perform a pumping action when the button part is pressed or released.

Furthermore, preferably, a coupling groove corresponding to the guide protrusion is formed in the inner surface of the rotating part in a vertical direction, and the guide protrusion is inserted into the coupling groove so that the pressing part is rotated together with the rotating part, and when the rotating part rotates, the guide protrusion is moved along the inclined guide groove, and at the same time, is vertically moved along the coupling groove.

Additionally, preferably, a rotation guide groove in which the guide protrusion is inserted is formed in the outer circumferential surface of the pumping guide part so that the pumping guide part is rotated together with the pressing part, and a tiered step is formed at one side of the rotation guide groove to be pressed downwards by the guide protrusion when the button part is pressed.

Moreover, preferably, when the rotating part is rotated, the pumping guide part is rotated together with the pressing part, and when the button part is elevated, the guide protrusion gets out of the rotation guide groove and the pressing part is rotated relative to the pumping guide part. When the pressing part is rotated relatively, the guide protrusion is arranged at a predetermined position of the upper surface of the tiered step and the pumping guide part is rotated together with the pressing part, so that the tiered step is arranged in the vertical guide groove, and the pumping guide part is lowered down together with the pressing part when the tiered step and the vertical guide groove are aligned mutually and the button part is pressed.

Furthermore, preferably, at least one extension part extends downwards from the lower portion of the pumping guide part, and a support part corresponding to the extension part protrudes inwards from the inner circumferential surface of the elevation guide part. In the first state, the extension part is arranged on the upper portion of the support part to be supported by the support part, so that it is prevented that the pumping action is carried out by the button part pressed.

Additionally, preferably, in the second state, the contents are contained in at least a portion of the inhalation space. When the second state is changed into the first state, the pressing part is lowered relative to the pumping guide part so that the volume of the inhalation space is decreased, and the decreased volume of the inhalation space is smaller than the remaining volume of the inhalation space in the second state, so that it is prevented that the contents are leaked out during the process that the second state is changed into the first state.

Advantageous Effects

The cosmetic container having the retractable button according to the present invention can prevent a leakage of the contents and prevent the contents from being hardened at the front end of the discharge part since inhaling the contents remaining at the front end of the discharge part by changing the volume of the inhalation space formed in the button.

Moreover, the cosmetic container having the retractable button according to the present invention can prevent a leakage of the contents while the button is lowered since the volume of the inhalation space reduced while the button is lowered by rotation of the rotating part is smaller than the remaining volume of the inhalation space formed in the state where the button is elevated.

Furthermore, the cosmetic container having the retractable button according to the present invention can enhance stability of products since having the structure that only the button is elevated and lowered by rotation of the rotating part in the state where the container body is fixed when the button is elevated or lowered, and can reduce the unit price of products since the container body is a unit container.

Additionally, the cosmetic container having the retractable button according to the present invention can prevent unnecessary discharge of the contents and improve user convenience since the button is exposed out of the rotating part by the rotating action of the rotating part in order to discharge the contents just when the user wants.

DESCRIPTION OF DRAWINGS

The above and other objects, features and advantages of the present invention will be apparent from the following detailed description of the preferred embodiments of the invention in conjunction with the accompanying drawings

MODE FOR INVENTION

Figure 1:
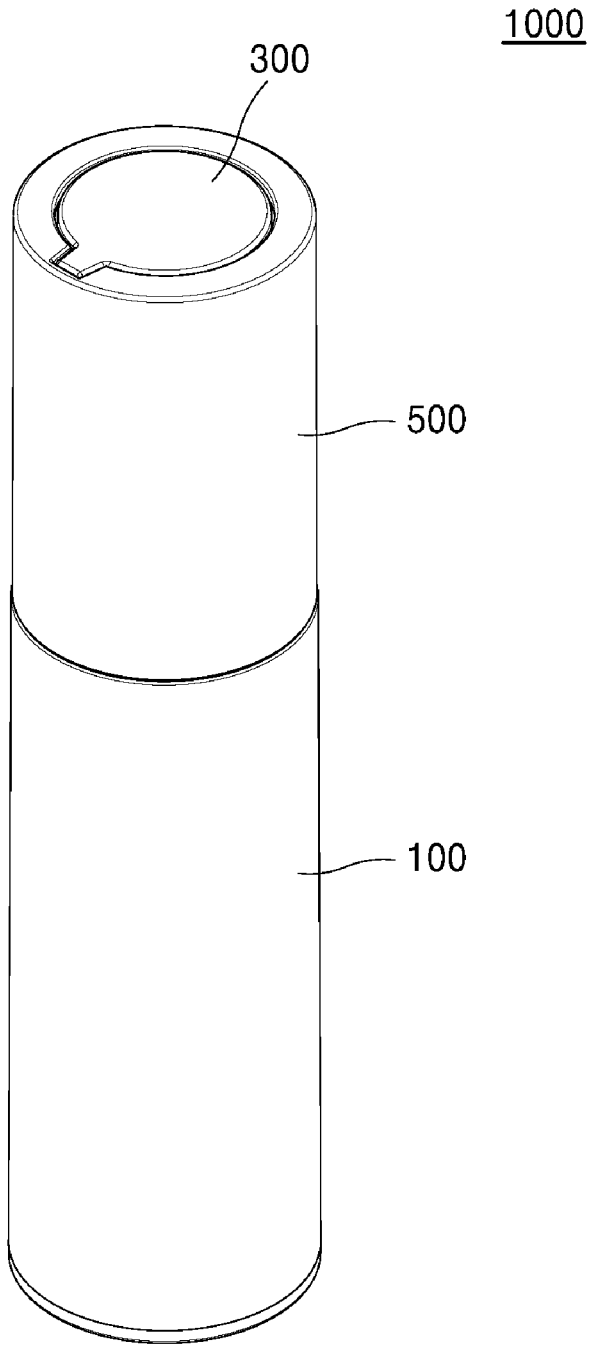
FIG. 1 is a perspective view of a cosmetic container according to a preferred embodiment of the present invention.

Hereinafter, exemplary embodiments of the present invention will be described with reference to the accompanying drawings. In the following description, the same elements will be designated by the same reference numerals although they are shown in different drawings. Further, in the following description of the present invention, a detailed description of known functions and configurations incorporated herein will be omitted when it may make the subject matter of the present invention rather unclear. In addition, a preferred embodiment of the present invention will be described hereinbelow, the technical thought of the present invention is not restricted or limited thereto and may be embodied in various manners through modification by those skilled in the art. In the meantime, for convenience's sake, all directions described hereinafter are written based on the drawings, and the technical scope of the present invention is not limited by the relevant directions.

Throughout this specification, when a part is referred to as being "connected" to another part, this includes "direct connection" and "indirect connection" via an intervening part. Also, when a certain part "includes" a certain component, other components are not excluded unless explicitly described otherwise, and other components may in fact be included. Moreover, in describing elements of the present invention, terms such as first, second A, B, (a), (b) and others may be used. Such terms are used only for purposes of distinguishing an element from other element, but do not limit the substance of the element, sequence or order.

Figure 2:
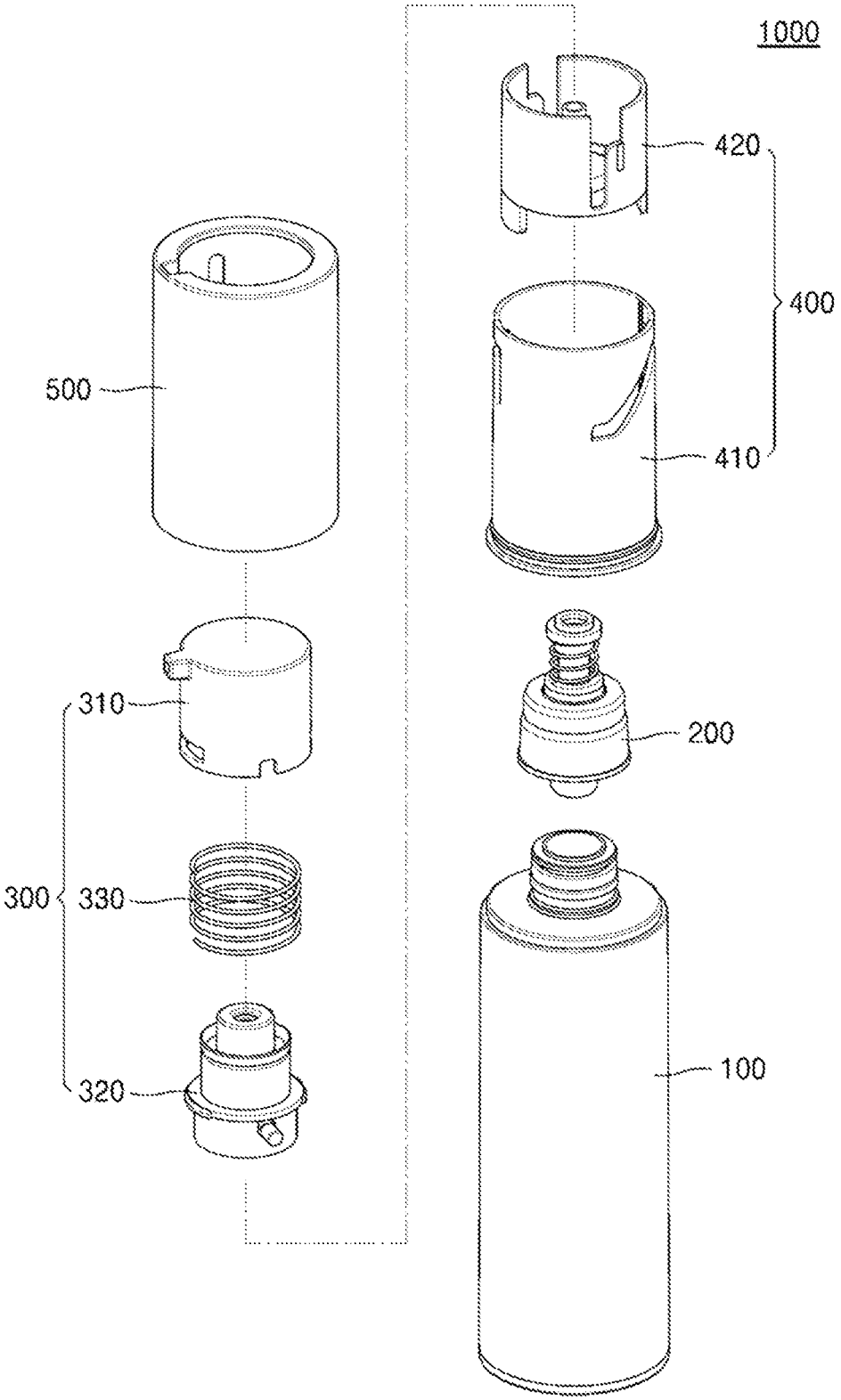
FIG. 2 is an exploded perspective view of the cosmetic container according to the preferred embodiment of the present invention.
Figure 3:
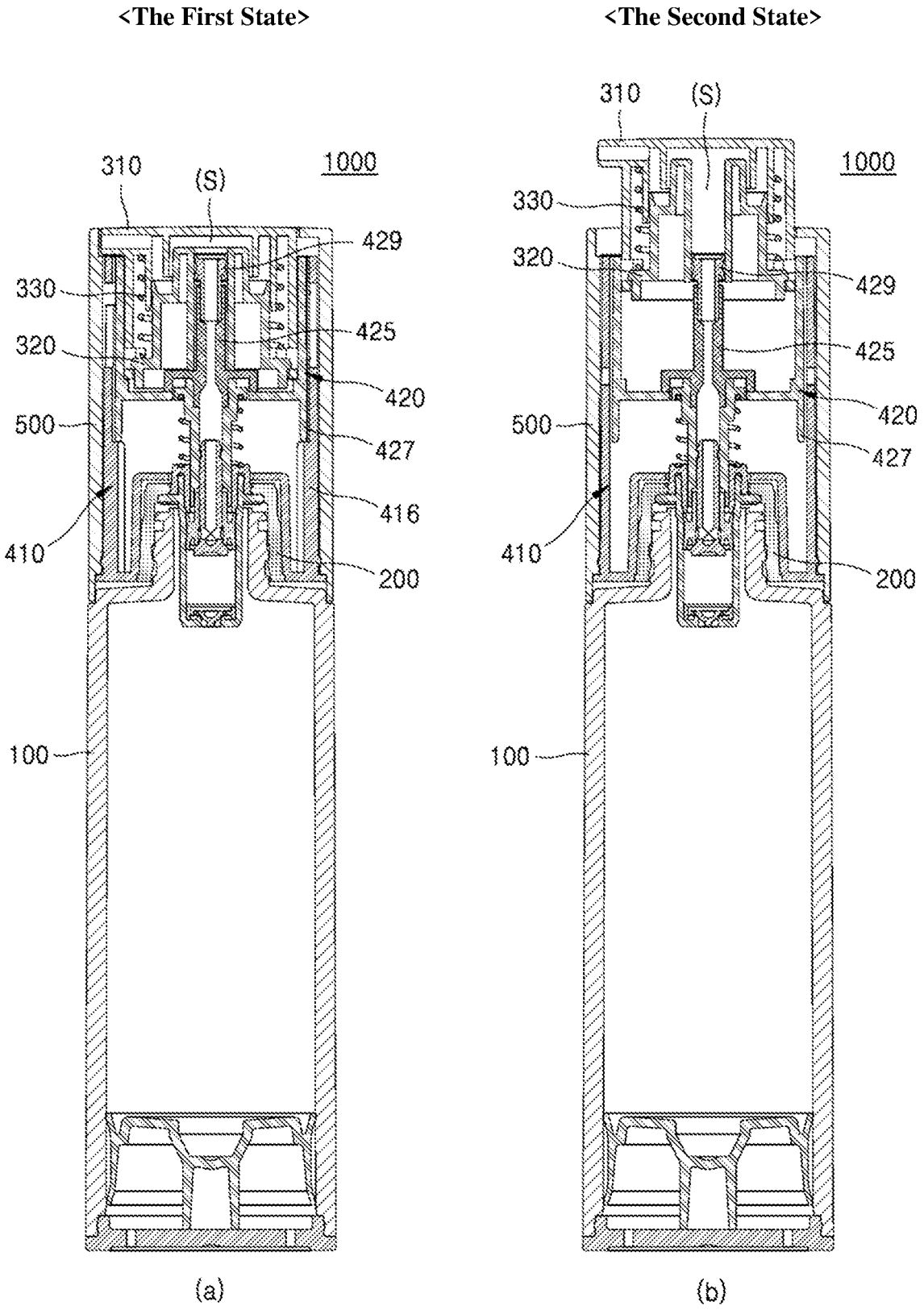
FIG. 3 is a sectional view of the cosmetic container according to the preferred embodiment of the present invention.
Figure 4:
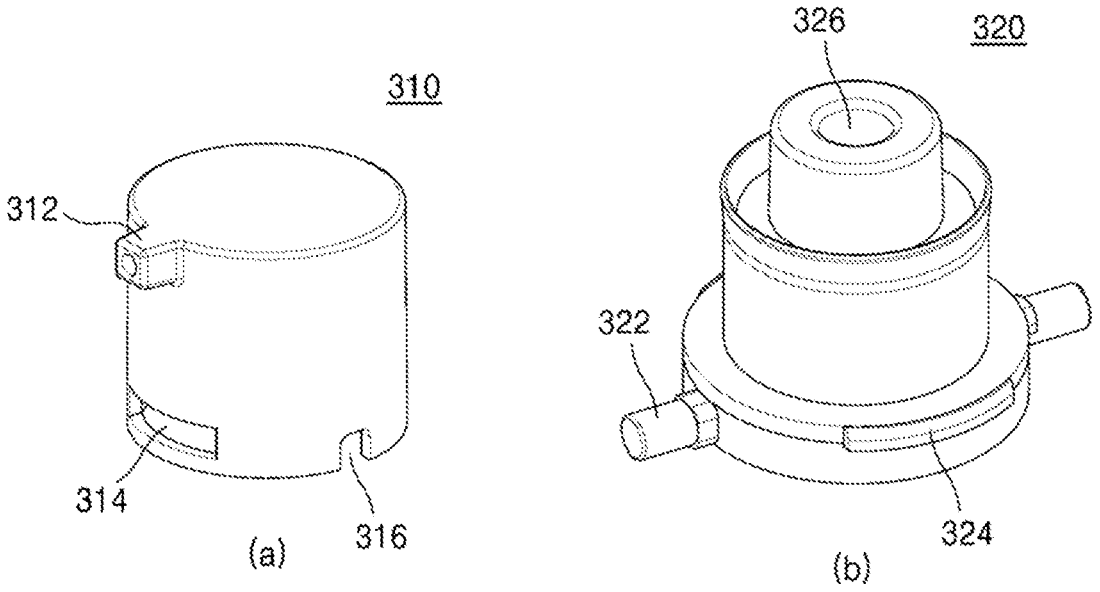
FIG. 4 is a perspective view of a cap part and a pressurizing part of the cosmetic container according to the preferred embodiment of the present invention.
Figure 5:
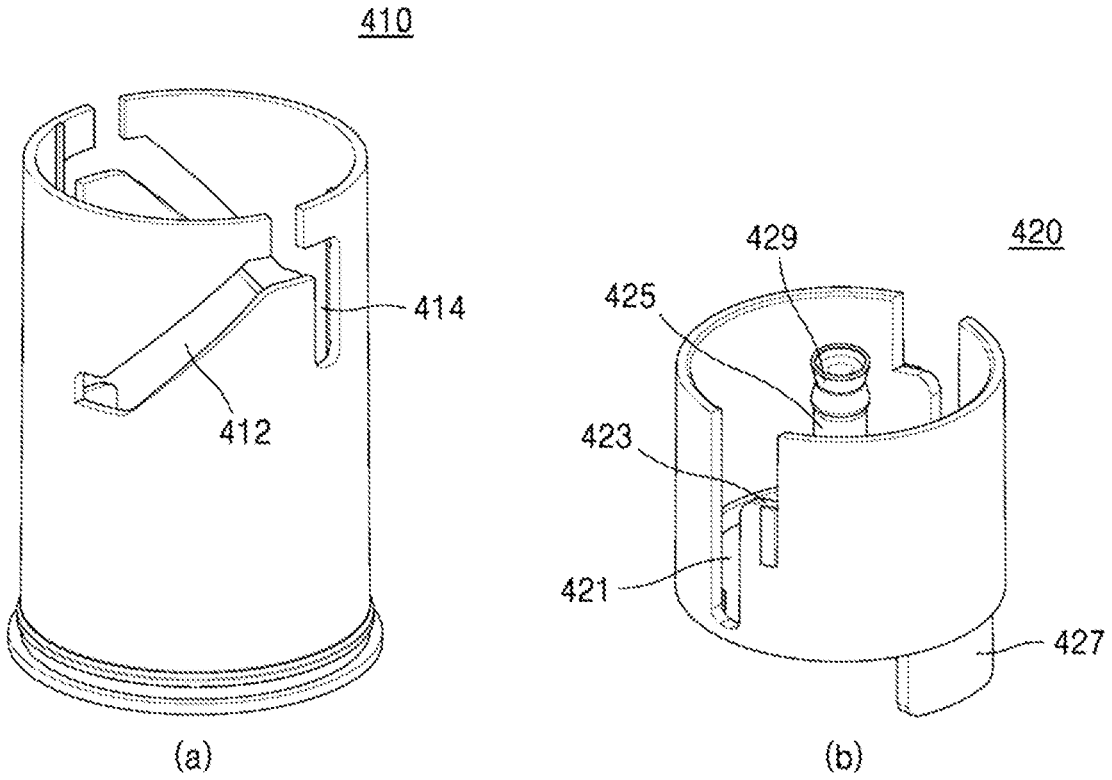
FIG. 5 is a perspective view of an elevation guide part and a pumping guide part of the cosmetic container according to the preferred embodiment of the present invention.
Figure 6:
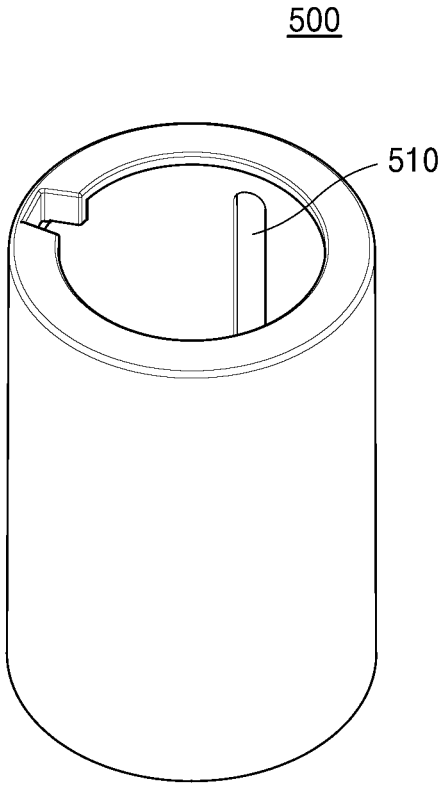
FIG. 6 is a perspective view of a rotating part of the cosmetic container according to the preferred embodiment of the present invention.

FIG. 1 is a perspective view of a cosmetic container according to a preferred embodiment of the present invention, FIG. 2 is an exploded perspective view of the cosmetic container according to the preferred embodiment of the present invention, FIG. 3 is a sectional view of the cosmetic container according to the preferred embodiment of the present invention, FIG. 4 is a perspective view of a cap part and a pressurizing part of the cosmetic container according to the preferred embodiment of the present invention, FIG. 5 is a perspective view of an elevation guide part and a pumping guide part of the cosmetic container according to the preferred embodiment of the present invention, and FIG. 6 is a perspective view of a rotating part of the cosmetic container according to the preferred embodiment of the present invention.

Referring to FIGS. 1 to 6, a cosmetic container 1000 includes a container body 100, a pump part 200, a button part 300, an elevation guide part 410, a pumping guide part 420, and a rotating part 500.

The container body 100 can store contents therein. Here, the contents may be, for instance, cosmetics, such as liquid-phase or gel-phase serum, essence, or cream, but is not limited to the above. The container body 100 may contain all kinds of materials which can be discharged by a pumping action, such as liquid-phase or gel-phase medical supplies or quasi drugs.

A discharge part (not shown) may be formed at the upper portion of the container body 100 in order to discharge the contents stored therein. The pump part 200, which will be described later, is combined with the discharge part of the container body 100. For such combination, at least one screw thread is formed on the outer circumferential surface of the discharge part so as to be coupled with the pump part 200. For instance, the discharge part has a screw thread formed on the outer circumferential surface and the pump part 200 has a screw thread formed on the inner circumferential surface, so that the pump part 200 is arranged on the upper portion of the container body 100 by being screw-coupled with the discharge part.

Moreover, a piston (not shown), which ascends according to use of the contents may be arranged inside the container body 100.

The pump part 200 is arranged on the upper portion of the container body 100, and performs the pumping action depending on the button being pressed or released and pulls up the contents stored in the container body 100 in order to discharge the contents out. Such a pump part 200 may be combined with the upper portion of the container body 100 through screw-coupling, but is not limited to the above, and may be combined with the container body 100 through various coupling structures. The pump part 200 can perform the pump action through various configurations known in the relevant fields.

The button part 300 makes the pump part 200 perform the pumping action when a user presses or releases the button part 300. In detail, the cosmetic container 1000 according to the present invention may be changed into the first state where the button part 300 lowers and the discharge part 312 is accommodated in the rotating part 500 when the rotating part 500 is rotated or into the second state where the button part 300 is elevated completely and the discharge part 312 is exposed out of the rotating part 500. Therefore, only when the user wants to use the contents, the user can change the cosmetic container 100 into the second state by rotating the rotating part 500, and then, presses the button part 300 to discharge the contents out.

The button part 300 includes a cap part 310, a pressing part 320, and an elastic part 330.

The cap part 310 is pressed or released by the user, and is coupled with the pressing part 320 while wrapping at least a part of the upper portion of the pressing part 320. The cap part 310 further includes one or more retaining grooves 314 formed on the outer circumferential surface of the cap part 310 so as to be coupled with the pressing part 320.

The pressing part 320 is arranged inside the cap part 310. The pressing part 320 rotates together with the rotating part 500 to elevate or lower the button part 300. Furthermore, the pressing part 320 can transfer pressure to the pumping guide part 420 and he pump part 200.

For transfer of pressure, guide protrusions 322 protrude from both sides of the outer circumferential surface of the pressing part 320. Such guide protrusions 322 are inserted into coupling grooves 510 vertically formed in the inner surface of the rotating part 500, so that the pressing part 320 can rotate together with the rotating part 500. Additionally, the guide protrusions are inserted into inclined guide grooves 412 of an elevation guide 410 in order to move along the inclined guide grooves 412 by rotation of the rotating part 500 and the pressing part 320, so that the button part 300 can be elevated and lowered. In addition, in the second state where the button part 300 is elevated, the guide protrusions 322 are arranged on tiered steps 423 of the pumping guide part, and presses the tiered steps 423 downwards when the user applies external force to the cap part 310, so that pressure can be transferred to the pumping guide part 420 and the pump part 200.

The pressing part 320 has a content moving hole 326 perforated at the center thereof to be communicated with the discharge part 312 and/or the pump part 200, so that the contents can move to the discharge part 312. Moreover, the pressing part 320 further has one or more retaining protrusions 324 formed on the outer circumferential surface of the pressing part 320 to correspond to the retaining grooves 314 of the cap part 310. Such retaining protrusions 324 are respectively inserted into the retaining grooves 314 of the cap part, so that the pressing part 320 is coupled with the cap part 310.

The elastic part 330 is arranged between the cap part 310 and the pressing part 320 to generate elastic force upwards toward the cap part 310. Preferably, the elastic part 330 is a spring, but is not limited to the spring and may be implemented through various materials having elasticity according to embodiments applied to the present invention.

Meanwhile, through the elastic part 330, the button part 300 has a space formed therein to communicate with the discharge part 312 and the content moving hole 326. In detail, the upper surface of the inner face of the cap part 310 and the upper surface of the pressing part 320 are arranged to be spaced apart from each other at a predetermined interval by the elastic force of the elastic part 330, so that a space is formed between the cap part 310 and the pressing part 320.

Such a space is communicated with the content moving hole 326 so as to form an inhalation space (s) inside the button part 300. That is, the inhalation space (s) is formed by the inside of the content moving hole 326 and the space communicating with the content moving hole 326, and the contents are accommodated in at least a part of the inhalation space (s).

In an embodiment, the inhalation space (s) may be decreased or increased in volume according to the user's pressurization and release to the button part 300. That is, when the user presses or releases the button part 300, the elastic part 330 is compressed or restored and the interval between the cap part 310 and the pressing part 320 is changed, so that the volume of the inhalation space (s) is decreased or increased. Therefore, the inhalation space (s) serves to inhale the contents remaining in the discharge part 312 after the contents are discharged.

In this instance, the change in volume of the inhalation space (s) depending on the user's pressurization and release may be limited within a predetermined range by the retaining grooves 314 and the retaining protrusions 324. That is, the retaining grooves 314 are formed to have a predetermined height, and the retaining protrusions 324 inserted into the retaining grooves 314 may be formed to be smaller in height or thickness than the retaining grooves 314. Accordingly, when the user presses or releases the cap part 310, the retaining protrusions 324 are relatively moved in the upward direction inside the retaining grooves 314 but are limited in movement distance by the retaining grooves 314. Therefore, the cap part 310 can do a vertical movement within the limited range relative to the pressing part 320, so that the volume of the inhalation space (s) can be changed within a predetermined range. An action of the cosmetic container 1000 in connection with the above will be described in more detail referring to FIG. 8.

In the meantime, moving holes 316 in which the guide protrusions 322 are inserted are formed in the outer circumferential surface of the cap part 310. The height of the moving holes 316 is larger than the vertical thickness of the guide protrusion 322, so that the cap part 310 can move relative to the pressing part 320 when the cap part 310 is pressed ore released.

The guide part 400 is arranged on the upper portion of the container body 100 to guide elevation of the button part 300 and to transfer pressure, which is generated by the pressed button part 300, to the pump part 200. The guide part 400 includes the elevation guide part 410 and the pumping guide part 420.

The elevation guide part 410 is mounted above the container body 100 to surround the pump part 200. In this instance, the elevation guide part 410 is fixed to the container body 100, and is not rotated together with the rotating part 500 when the rotating part 500 rotates relative to the container body 100. For instance, at least one fixing protrusion is formed on the outer circumferential surface of the pump part 200 combined with the upper portion of the container body 100, and a fixing groove corresponding to the fixing protrusion of the pump part 200 is formed in the inner circumferential surface of the elevation guide part 410. When the fixing protrusion is coupled with the fixing groove, the elevation guide part 410 is fixed to the container body 100 to rotate relative to the rotating part 500. However, the above is exemplary, and the rotating part 500 may be rotated relative to the elevation guide part 410 through various methods according to embodiments to which the present invention is applied.

The elevation guide part 410 can guide elevation of the button part 300, especially, the pressing part 320, when the rotating part 500 rotates. So, guide grooves 412 and 414 may be formed in the outer circumferential surface of the elevation guide part 410 so that the guide protrusion 322 of the pressing part 320 is inserted into the guide grooves to be moved.

The guide grooves 412 and 414 includes an inclined guide groove 412 and a vertical guide groove 414.

The inclined guide grooves 412 guide elevation of the pressing part 320 according to rotation of the rotating part 500. The inclined guide grooves 412 may be formed by some area of the outer circumferential surface of the elevation guide part 410 being penetrated, and the guide protrusions 322 are inserted into the inclined guide grooves 412 to move along the inclined guide grooves 412. The inclined guide grooves 412 are formed in the circumferential direction from an area of the lower portion of the elevation guide part 410 to an area of the upper portion, and are inclined at a predetermined angle toward the upper portion of the elevation guide part 410.

Preferably, a pair of the inclined guide grooves 412 are formed at both sides of the outer circumferential surface of the elevation guide part 410 to correspond to each other so that the guide protrusions 322 can move stably. However, the present invention is not limited to the above, and the inclined guide grooves 412 may be implemented in various forms according to embodiments to which the present invention is applied.

The vertical guide groove 414 may extend to a predetermined length downwardly from the upper end portion of the inclined guide groove 412. In the second state that the button part 300 is elevated, when the guide protrusion 322 is located above the vertical guide groove 414, the guide protrusion 322 is inserted into the vertical guide groove 414 according to pressurization or release and is moved vertically. Therefore, the user can press the button part 300 to perform the pumping action.

The pumping guide part 420 is arranged on the upper portion of the pump part 200, receives pressure from the button part 300 through the guide protrusion 322, and transfers it to the pump part 200. Additionally, the pumping guide part 420 is rotated together with the pressing part 320 or is rotated relative to the pressing part 320 according to rotation of the rotating part 500.

Rotation guide grooves 421 and the tiered steps 423 are formed in the outer circumferential surface of the pumping guide part 420.

The rotation guide groove 421 is formed in an area of the outer circumferential surface of the pumping guide part 420 in the longitudinal direction. The guide protrusion 322 is inserted into the rotation guide groove 421 so that the pumping guide part 420 and the pressing part 320 are rotated together when the rotating part 500 is rotated. In this instance, the guide protrusion 322 vertically moves, namely, ascends along the rotation guide groove 421. When the guide protrusion 322 gets out of the rotation guide groove 421 by such a vertical movement, the pumping guide part 420 and the pressing part 320 are relatively rotated till the guide protrusion 322 is located on the upper surface of the tiered step 423.

Because the tiered step 423 is formed at one side of the rotation guide groove 421, when the button part 300 is pressed by the guide protrusion 322 in the second state, pressure for the pumping action is transferred to the pump part 200. In detail, in the second state where the button part 300 is raised, the guide protrusion 322 gets out of the rotation guide groove 421 and is arranged above the tiered step 423 and the vertical guide groove 414. After that, when the user presses the button part 300, the tiered step 423 is pressed by the guide protrusion 322 and the pumping guide part 420 is moved downwards, so as to transfer pressure generated by pressurization of the cap part 310 to the pump part 200.

Moreover, an insertion part 425 inserted into the content moving hole 326 can extend upwards from the upper portion of the inside of the pumping guide part 420 to a predetermined length. The insertion part 425 has a hollow formed therein, and the content moving hole 326 and the pump part 200 are communicated with each other through the insertion part 425, so that the contents raised by the pumping action can be moved to the discharge part 312 through the content moving hole 326.

A seal cap part 429 is coupled to the upper portion of the insertion part 425. Such a seal cap part 429 is inserted into the content moving hole 326, and the outer circumferential surface of the upper portion of the seal cap part 429 is arranged to get in contact with the inner circumferential surface of the content moving hole 326 in order to prevent the contents from getting out through a space formed between the content moving hole 326 and the insertion part 425.

Figure 9:
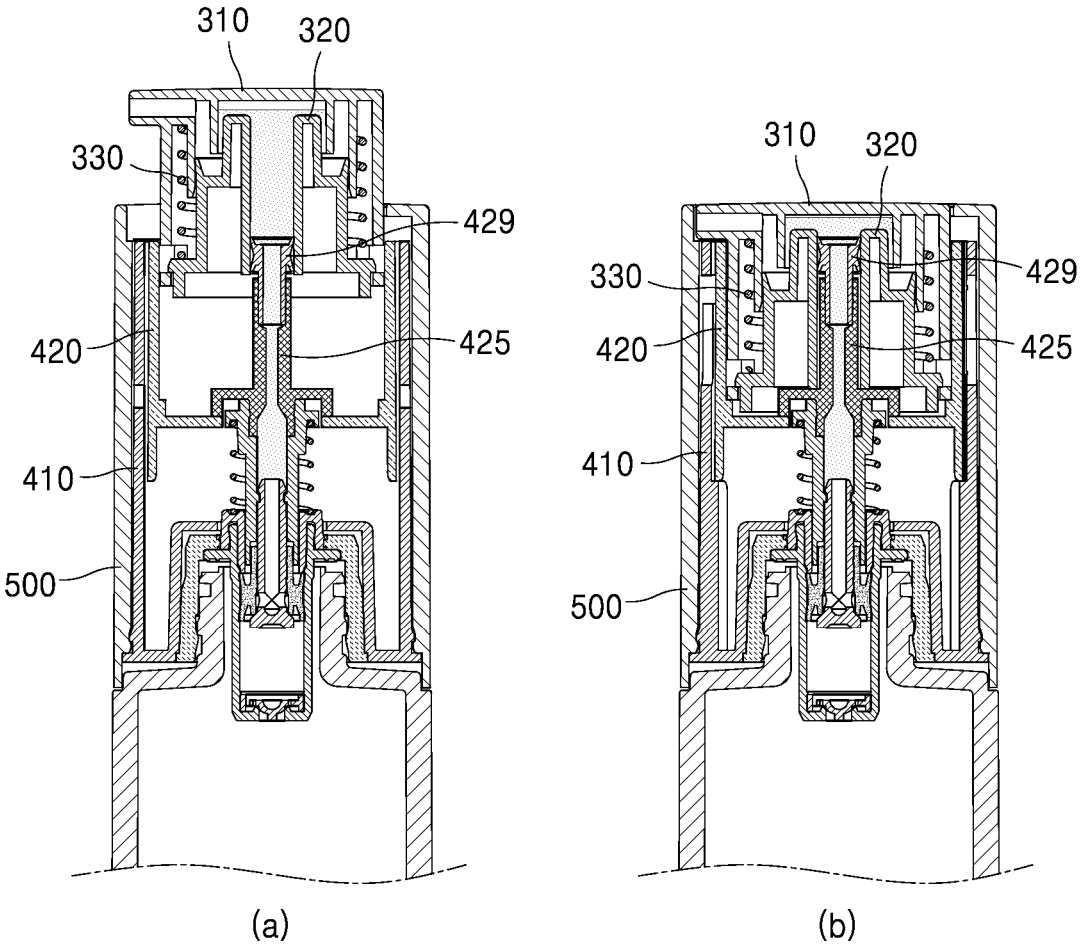
FIG. 9 is a view showing a further example of the operation of the cosmetic container according to the preferred embodiment of the present invention.

Meanwhile, the insertion part 425 and the seal cap part 429 can be relatively lowered or elevated inside the content moving hole 326 when the cosmetic container 1000 is changed from the first state into the second state or from the second state into the first state. Therefore, the volume of the inhalation space (s) can be increased or decreased. Referring to FIG. 9, the operation of the cosmetic container 1000 will be described in more detail.

At least one extension part 427 is extended downwards from the lower portion of the pumping guide part 420. Such an extension part 427 can prevent the pumping action from being performed by the user's power in the first state that the button part 300 is lowered. That is, a support part 416 protrudes inwards from the inner circumferential surface of the elevation guide part 410 in correspondence to the extension part 427 of the pumping guide part 420, and the extension part 427 is arranged on the upper portion of the support part 416 in the first state, so as to prevent the pumping action from being performed even though the button part 300 is pressed. In the meantime, when the button part 300 is changed into the second state, the extension part 427 separated from the upper portion of the support part 416.

The rotating part 500 is coupled to be rotated relatively while wrapping the elevation guide part 410 at the upper portion of the container body 100, so as to rotate in one direction or in the opposite direction by receiving rotary power from the user.

The rotating part 500 transfers the rotary power to the pressing part 320 to rotate together with the pressing part 320. For this, the coupling groove 510 in which the guide protrusion 322 of the pressing part 320 is inserted is vertically extended from the inner surface of the rotating part 500 to a predetermined length. As described above, when the rotating part 500 and the pressing part 320 are rotated together, the pressing part 320 can be increased or decreased since the guide protrusion 322 is moved vertically along the coupling groove 510.

The rotating part 500 has an inner shape corresponding to the shape of the cap part 310 so that the discharge part 312 can get into or out of the rotating part 500 according to elevation or lowering of the button part 300. In this instance, a limiting jaw (not shown) protrudes inwards on the inner surface of the rotating part 500, so that the lower surface of the discharge part 312 is seated on the limiting jaw in the first state. Therefore, even though the cap part 310 is pressed, it is prevented that the cap part 310 is moved vertically.

Figure 7:
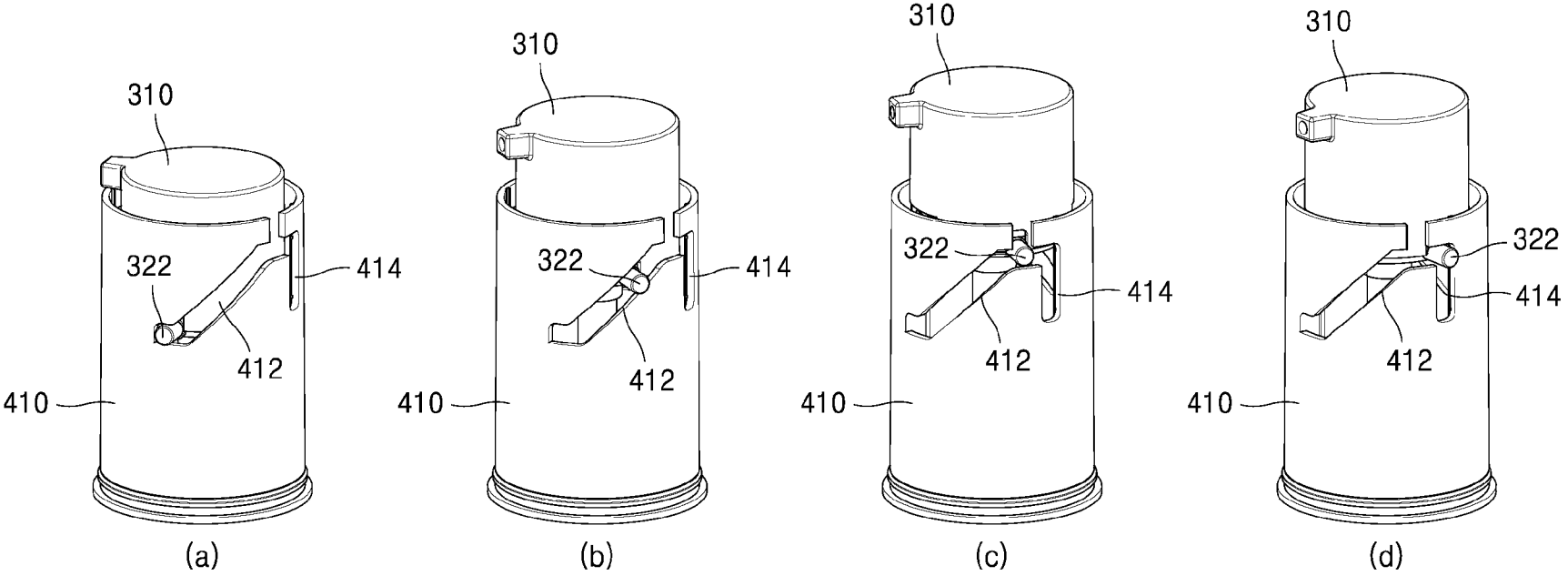
FIG. 7 is a view showing an example of an operation of the cosmetic container according to the preferred embodiment of the present invention.

FIG. 7 is a view showing an example of the operation of the cosmetic container according to the preferred embodiment of the present invention. In more detail, FIG. 7 illustrates the action that the button part is rotated and/or elevated according to rotation of the rotating part and the cosmetic container is changed from the first state to the second state.

Referring to FIG. 7(*a*), in the first state where the button part 300 is accommodated in the rotating part 500, the guide protrusion 322 of the pressing part 320 is arranged at the lower end portion of the inclined guide groove 412.

Next, as shown in FIG. 7(*b*), when the user rotates the rotating part 500 in one direction, the guide protrusion 322 moves upwards in the rotational direction along the inclined guide groove 412, and at the same time, is vertically moved relative to the coupling groove 510 of the rotating part 500 and the rotation guide groove 421 of the pumping guide part 420, so that the pressing part 320 and the button part 300 are elevated. In this instance, since the guide protrusion 322 is inserted into the rotation guide groove 421, the pumping guide part 420 is rotated together with the pressing part 320.

Continuously, when the user rotates the rotating part 500 in one direction, as shown in FIG. 7(*c*), the guide protrusion 322 is arranged on the upper end portion of the inclined guide groove 412. The guide protrusion 322 gets out of the rotation guide groove 421 of the pumping guide part 420, so that the pressing part 320 and the pumping guide part 420 can rotate relatively. Due to the relative rotation, the guide protrusion 322 makes horizontal movement in the rotational direction, and is arranged on the upper surface of the tiered step 423. After that, when the guide protrusion 322 gets in contact with a side wall (not shown) extending upwards from one side end portion of the tiered step 423, the guide protrusion 322 presses the side wall, so that the pressing part 320 and the pumping guide part 420 can rotate together.

Next, when the user rotates the rotating part 500 more in one direction, as shown in FIG. 7(*d*), the button part 300 completes the change into the second state. In this instance, the pressing part 320 and the pumping guide part 420 are rotated together, so that the guide protrusion 322 and the tiered step 423 can be arranged in the vertical guide groove 414 of the elevation guide part 410. Therefore, when the user presses the button part 300 exposed externally, pressure is transferred to the pumping guide part 420 and the pumping guide part 420 is lowered, so that the pumping action of the pump part 200 can be performed.

Figure 8:
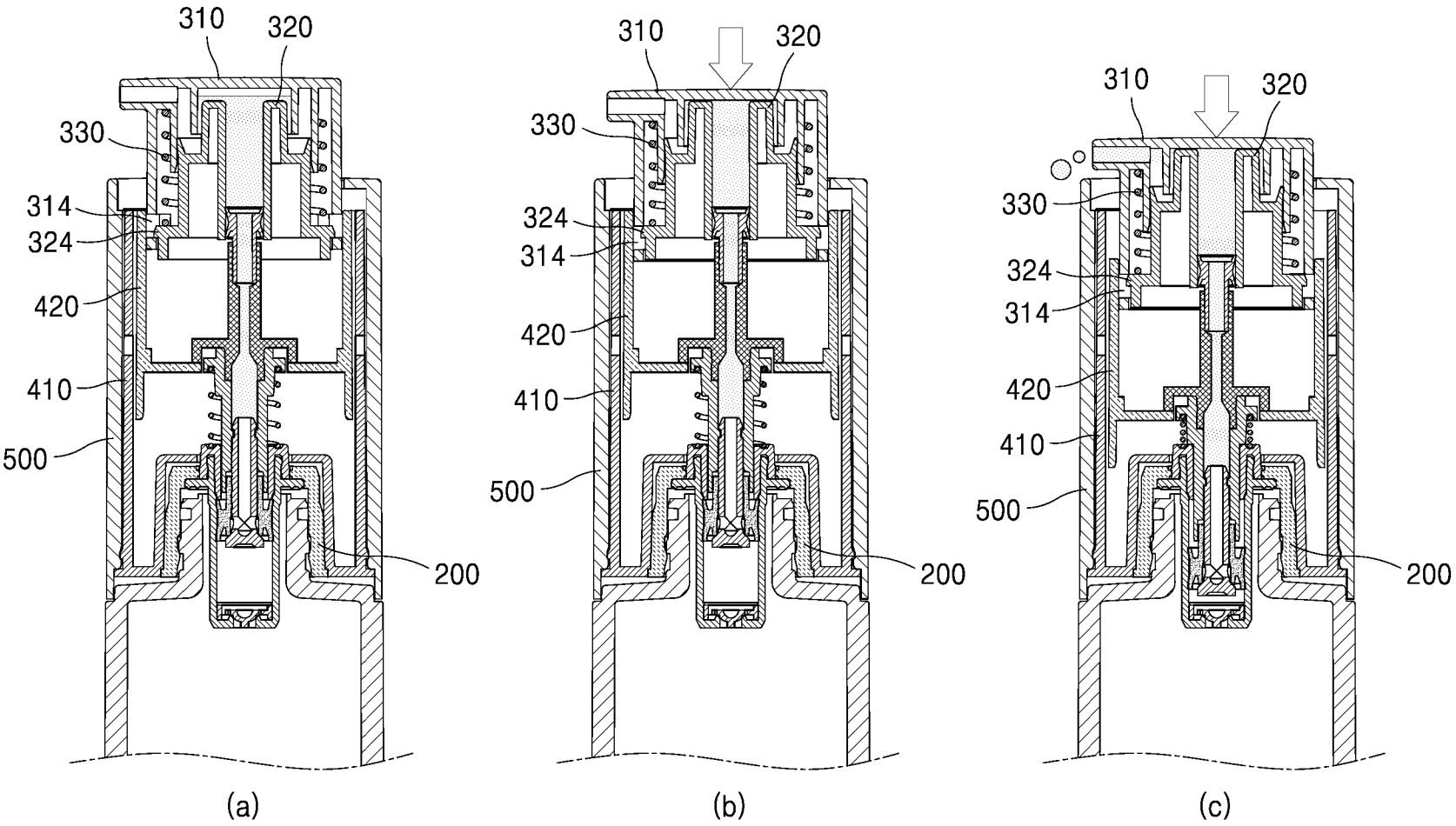
FIG. 8 is a view showing another example of the operation of the cosmetic container according to the preferred embodiment of the present invention.

FIG. 8 is a view showing another example of the operation of the cosmetic container according to the preferred embodiment of the present invention. In more detail, FIG. 8 illustrates a process that the contents are discharged when the user presses the button part in the second state of the cosmetic container.

Referring to FIG. 8(*a*), in the second state, if the user does not press the cap part 310, the inhalation space (s) has the maximum volume. In this instance, the contents are contained in the inhalation space (s), but the upper portion of the inhalation space (s) forms a remaining space or a remaining volume since the upper portion is not filled with the contents.

After that, when the user first presses the cap part 310, as shown in FIG. 8(*b*), the elastic part 330 is pressed, and the cap part 310 is lowered relative to the pressing part 320. In this instance, the upper surface of the retaining protrusion 324 is caught to the retaining groove 314 by getting in contact with the retaining groove 314, so that the cap part 310 is lowered to a limited distance relative to the pressing part 320, and so, the volume of the inhalation space (s) is reduced. In this instance, the inhalation space (s) is filled with the contents, so that the remaining space or remaining volume in the inhalation space (s) is removed.

Continuously, when the user second presses the cap part 310, as shown in FIG. 8(*c*), the cap part 310, the pressing part 320, and the pumping guide part 420 are lowered together, so that the pumping action can be performed. Therefore, the contents move upwards, pass through the insertion part 425 and the content moving hole 326, and are discharged out through the discharge part 312.

Here, the first pressurization and the second pressurization can be carried out continuously by just one pressing action.

Next, after the contents are discharged, when the user releases the cap part 310 pressed, by restoring force of the elastic part (not shown) disposed in the pump part 200 and restoring force of the elastic part 330 disposed in the button part 300, the cosmetic container 1000 is restored to the state of FIG. 8(*a*).

Accordingly, the volume of the inhalation space (s) inside the button part 300, which was decreased by the cap part 310 pressed is increased, so that the inhalation (suck-back) action to inhale the contents remaining in the discharge part 312 can be carried out. After the contents are discharged, since the contents remaining in the discharge part 312 are inhaled, it can prevent a leakage of the contents.

FIG. 9 is a view showing a further example of the operation of the cosmetic container according to the preferred embodiment of the present invention. In more detail, FIG. 9(*a*) is a sectional view showing the second state where the button part is elevated, and FIG. 9(*b*) is a sectional view of the first state where the button part is lowered.

First, referring to FIG. 9(*a*), the inhalation space (s) has the maximum volume in the second state, and the contents are contained in the inhalation space (s), but the upper portion of the inhalation space (s) has a remaining space or volume which is not filled with the contents.

Referring to FIG. 9(*b*), when the user rotates the rotating part 500 in one direction to change the cosmetic container 1000 into the first state, the pressing part 320 is lowered, so that the insertion part 425 and the seal cap part 429 are relatively elevated inside the content moving hole 326. Therefore, the inserted length of the insertion part 425 inserted into the content moving hole 326 is increased, and the volume of the inhalation space (s) is decreased.

In this instance, the volume of the inhalation space (s) which is decreased by the cosmetic container 1000 being changed into the first state is smaller than the remaining volume of the inhalation space (s) formed in the second state. Therefore, even though the cosmetic container 1000 is changed from the second state to the first state, it is prevented that the contents are discharged out through the discharge part 312 by decrease in the volume of the inhalation space (s).

In the meantime, when rotates the rotating part 500 in the opposite direction to change the cosmetic container from the first state to the second state, the insertion part 425 and the seal cap part 429 are relatively lowered inside the content moving hole 326, so that the volume of the inhalation space is increased.

Figure 10:
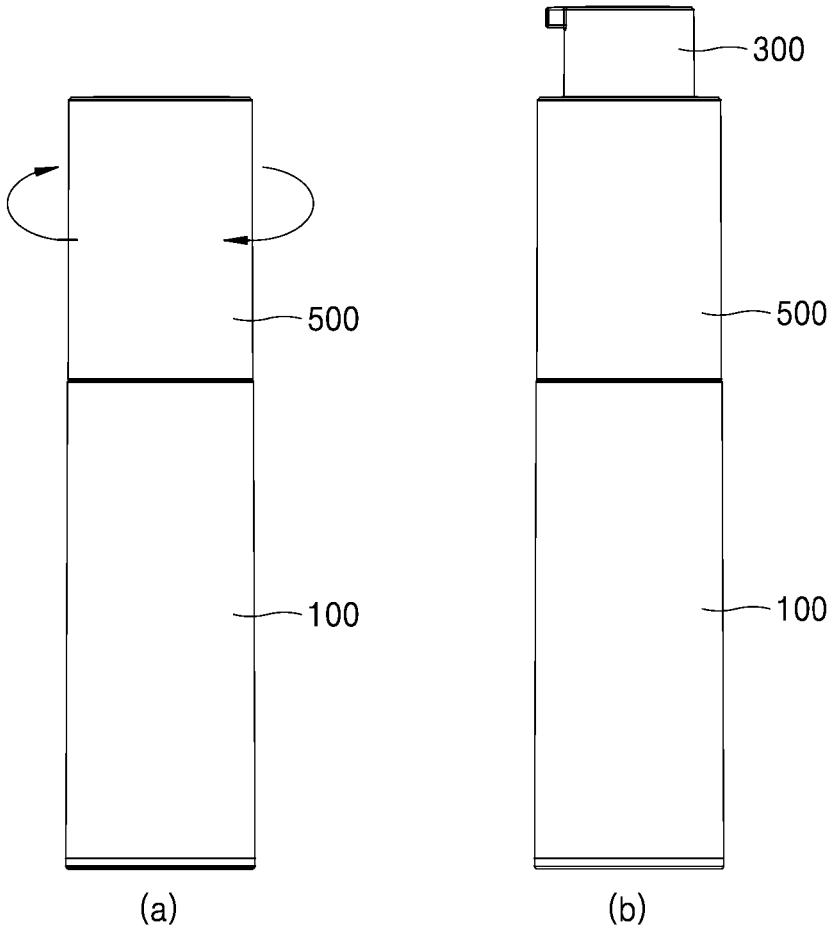
FIG. 10 is a view showing a still further example of the operation of the cosmetic container according to the preferred embodiment of the present invention.

FIG. 10 is a view showing a still further example of the operation of the cosmetic container according to the preferred embodiment of the present invention.

Referring to FIG. 10(*a*), when the user does not use the cosmetics, the user can carry or store the cosmetic container 1000 after making the cosmetic container 1000 into the first state where the button part 300 is accommodated in the rotating part 500. In the first state, as described above, even though the button part 300 is pressed, since the pumping action of the pump part 200 is not carried out, the contents are not discharged out.

Referring to FIG. 10(*b*), when the user wants to use the cosmetics, the user rotates the rotating part 500 in one direction in order to change the cosmetic container 1000 into the second state where the button part 300 is elevated, so that the discharge part 312 is exposed out of the rotating part 500. Continuously, when the user presses the button part 300, the contents are discharged out by the pumping action of the pump part 200.

After that, when the use of the cosmetic is finished, the user rotates the rotating part 500 in the opposite direction, so that the cosmetic container is changed from the second state to the first state.

While the present invention has been particularly shown and described with reference to exemplary embodiments thereof and specific terms are used, it will be understood by those of ordinary skill in the art that the terms are just used to explain the present invention and are not used to limit the meanings or limit the technical scope of the present invention described in claims. Therefore, it will be understood by those of ordinary skill in the art that various changes, modifications and equivalents may be made therein without departing from the technical idea and scope of the present invention. Accordingly, the actual technical protection scope of the present invention must be determined by the spirit of the appended claims.

The invention claimed is:

1. A cosmetic container having a retractable button, the cosmetic container comprising:

a container body filled with contents;

a pump part disposed on one end portion of the container body, and configured to discharge the contents externally through a pumping action;

a button part disposed on one end portion of the pump part to make the pumping action, and having a discharge part to discharge the contents externally;

a rotating part coupled to the one end portion of the container body to relatively rotate to and rotate together with a pressing part by receiving rotary power from a user; and a guide part coupled to one end portion of the rotating part, configured to guide an elevation and a lowering of the button part according to a rotation of the rotating part, and configured to transfer pressure of the button part generated by a pressurization of the button part to the pump part, wherein the button part comprises:

a cap part pressed or released by the user, and having the discharge part disposed on one side of the cap part, the pressing part disposed inside of the cap part to transfer pressure of the cap part generated by a pressurization of the cap part to the pump part, and having a content moving hole configured to allow movement of the contents, and an elastic part disposed between the cap part and the pressing part to generate elastic force toward the cap part, wherein inner one end surface of the cap part and one end surface of the pressing part are spaced apart from each other at a predetermined interval by the elastic force of the elastic part, wherein the button part has an inhalation space formed inside the button part, and the inhalation space is communicated with the discharge part, wherein the inhalation space is a space surrounded by the cap part, the pressing part, and an inner surface of the content moving hole, wherein a first state is when the button part is lowered down and a second state is when the button part is elevated, wherein remaining volume is an empty space in the inhalation space when the button part is in the second state, wherein decreased volume of the inhalation space is a volume difference in the inhalation space between the first state and the second state, and wherein the decreased volume of the inhalation space is smaller than the remaining volume of the inhalation space.

2. The cosmetic container according to claim 1, wherein at least one retaining groove is disposed on an outer circumferential surface of the cap part to a predetermined height, and at least one retaining protrusion is disposed on an outer circumferential surface of the pressing part and is inserted into the retaining groove, wherein the retaining protrusion of the pressing part is vertically and relatively moved inside the retaining groove according to the pressurization and the release of the cap part, and wherein a vertical movement distance is limited by the predetermined height of the retaining groove and a volume of the inhalation space is changed within a limited range.

3. The cosmetic container according to claim 1, wherein at least one guide protrusion protrudes from an outer circumferential surface of the pressing part, and wherein the cosmetic container comprises:

an elevation guide part coupled to the rotating part, having a guide groove disposed on an outer circumferential surface of the elevation guide part and the guide protrusion inserted into the guide groove, and configured to guide the elevation and the lowering of the button part according to the rotation of the rotating part; and a pumping guide part coupled to the pressing part to rotate together with the pressing part or rotate relative to the pressing part, configured to receive the pressure of the cap part through the guide protrusion, and configured to transfer the pressure of the cap part to the pump part, wherein according to rotation of the rotating part, the cosmetic container is changed into the first state where the button part is lowered down and the discharge part is accommodated in the rotating part or into the second state where the button part is elevated and the discharge part is exposed to outside of the rotating part.

4. The cosmetic container according to claim 3, wherein the guide groove includes an inclined guide groove and a vertical guide groove extending downwards from one end portion of the inclined guide groove, wherein when the rotating part is rotated, the guide protrusion moves along the inclined guide groove to guide an elevation and a lowering of the pressing part, and wherein when the guide protrusion moves along the inclined guide groove and is located above the vertical guide groove, the guide protrusion vertically moves along the vertical guide groove to perform the pumping action when the button part is pressed or released.

5. The cosmetic container according to claim 4, wherein a coupling groove corresponding to the guide protrusion is disposed on an inner surface of the rotating part in a vertical direction, the guide protrusion is inserted into the coupling groove, and the pressing part is rotated together with the rotating part, and wherein when the rotating part rotates, the guide protrusion is moved along the inclined guide groove, and at the same time, is vertically moved along the coupling groove.

6. The cosmetic container according to claim 4, wherein a rotation guide groove in which the guide protrusion is inserted is disposed on an outer circumferential surface of the pumping guide part and the pumping guide part is rotated together with the pressing part, and wherein a tiered step is disposed on one side of the rotation guide groove to be pressed downwards by the guide protrusion when the button part is pressed.

7. The cosmetic container according to claim 6, wherein when the rotating part is rotated, the pumping guide part is rotated together with the pressing part, and when the button part is elevated, the guide protrusion gets out of the rotation guide groove and the pressing part is rotated relative to the pumping guide part, and wherein when the pressing part is rotated relatively, the guide protrusion is located at a predetermined position of one end surface of the tiered step and the pumping guide part is rotated together with the pressing part locating the tiered step in the vertical guide groove, and when the tiered step and the vertical guide groove are aligned, the pumping guide part is lowered down together with the pressing part according to the pressurization of the button part.

8. The cosmetic container according to claim 6, wherein at least one extension part extends downwards from an end portion of the pumping guide part, and a support part corresponding to the extension part protrudes inwards from the inner circumferential surface of the elevation guide part, and wherein in the first state, the extension part is arranged on one end portion of the support part and is supported by the support part, and the pumping action is prevented from being carried out by the pressurization of the button part.

9. A cosmetic container comprising:

a container body filled with contents;

a pump part disposed on one end portion of the container body, and configured to discharge the contents externally through a pumping action;

a button part disposed on one end portion of the pump part, and having a discharge part to discharge the contents externally, the button part comprising a cap part and a pressing part, wherein the pressing part has a content moving hole; and a guide part configured to guide an elevation and a lowering of the button part and configured to transfer pressure of the button part generated by a pressurization of the button part to the pump part, wherein inner one end surface of the cap part and one end surface of the pressing part are spaced apart from each other at a predetermined interval by elastic force of an elastic part, wherein the button part has an inhalation space formed inside the button part, and the inhalation space is communicated with the discharge part, wherein the inhalation space is a space surrounded by the cap part, the pressing part, an inner surface of the content moving hole, and the insertion part, wherein a first state is when the button part is lowered down and a second state is when the button part is elevated, wherein remaining volume is an empty space in the inhalation space when the button part is in the second state, wherein decreased volume of the inhalation space is a volume difference in the inhalation space between the first state and the second state, and wherein the decreased volume of the inhalation space is smaller than the remaining volume of the inhalation space.

10. The cosmetic container according to claim 9, wherein the button part comprises:

the cap part pressed or released by a user, and having the discharge part disposed on one side of the cap part;

the pressing part disposed inside of the cap part to transfer pressure of the cap part generated by a pressurization of the cap part to the pump part, and having the content moving hole configured to allow movement of the contents; and the elastic part disposed between the cap part and the pressing part to generate the elastic force toward the cap part.

11. The cosmetic container according to claim 10, wherein at least one retaining groove is disposed on outer circumferential surface of the cap part to a predetermined height, and at least one retaining protrusion is disposed on outer circumferential surface of the pressing part and is inserted into the retaining groove, wherein the retaining protrusion of the pressing part is vertically and relatively moved inside the retaining groove according to the pressurization and the release of the cap part, and wherein a vertical movement distance is limited by the predetermined height of the retaining groove and volume of the inhalation space is changed within a limited range.

12. The cosmetic container according to claim 10, wherein at least one guide protrusion protrudes from the outer circumferential surface of the pressing part, and wherein the cosmetic container comprises:

a rotating part coupled to the one end portion of the container body to relatively rotate to and rotate together with the pressing part by receiving rotary power from the user;

a guide part coupled to one end portion of the rotating part, configured to guide an elevation and a lowering of the button part according to a rotation of the rotating part, and configured to transfer pressure of the button part generated by pressurization of the button part to the pump part, wherein the guide part includes the insertion part;

an elevation guide part coupled to the rotating part, having a guide groove disposed on an outer circumferential surface of the elevation guide part and the guide protrusion inserted into the guide groove, and configured to guide the elevation and the lowering of the button part according to the rotation of the rotating part; and a pumping guide part coupled to the pressing part to rotate together with the pressing part or rotate relative to the pressing part, configured to receive the pressure of the cap part through the guide protrusion, and configured to transfer the pressure of the cap part to the pump part, wherein a rotation guide groove in which the guide protrusion is inserted is disposed on outer circumferential surface of the pumping guide part and the pumping guide part is rotated together with the pressing part, and wherein a tiered step is disposed on one side of the rotation guide groove to be pressed downwards by the guide protrusion when the button part is pressed.

13. The cosmetic container according to claim 9, wherein the volume difference in the inhalation space is generated by change of the second state into the first state by the pressurization of the cap part or by change of the first state into the second state by the release of the cap part.

14. The cosmetic container according to claim 9, wherein the volume difference in the inhalation space is generated by change of the second state into the first state by the rotation of the rotating part in one direction configured to lower the button part or by change of the first state into the second state by the rotation of the rotating part in another direction configured to elevate the button part.

15. A cosmetic container comprising:

a container body filled with contents;

a pump part disposed on one end portion of the container body, and configured to discharge the contents externally through a pumping action; and a button part disposed on one end portion of the pump part to make the pumping action, and having a discharge part to discharge the contents externally, wherein the button part comprises:

a cap part pressed or released by a user, and having the discharge part disposed on one side of the cap part;

a pressing part disposed inside of the cap part to transfer pressure of the cap part generated by a pressurization of the cap part to the pump part, and having a content moving hole configured to allow movement of the contents; and an elastic part disposed between the cap part and the pressing part to generate elastic force toward the cap part, wherein inner one end surface of the cap part and one end surface of the pressing part are spaced apart from each other at a predetermined interval by the elastic force of the elastic part, wherein a space between the cap part and the pressing part is communicated with the content moving hole, and the inhalation space is defined between the space and inner surface of the content moving hole, wherein at least one retaining groove is disposed on outer circumferential surface of the cap part to a predetermined height, and at least one retaining protrusion is disposed on outer circumferential surface of the pressing part and is inserted into the retaining groove, wherein the retaining protrusion of the pressing part is vertically and relatively moved inside the retaining groove according to the pressurization and the release of the cap part, and wherein a vertical movement distance is limited by the predetermined height of the retaining groove and volume of the inhalation space is changed within a limited range.

16. The cosmetic container according to claim 15, wherein at least one guide protrusion protrudes from the outer circumferential surface of the pressing part, and wherein the cosmetic container comprises:

a rotating part coupled to the one end portion of the container body to relatively rotate to and rotate together with the pressing part by receiving rotary power from the user;

a guide part coupled to one end portion of the rotating part, configured to guide an elevation and a lowering of the button part according to a rotation of the rotating part, and configured to transfer pressure of the button part generated by the pressurization of the button part to the pump part;

an elevation guide part coupled to the rotating part, having a guide groove disposed on an outer circumferential surface of the elevation guide part and the guide protrusion inserted into the guide groove, and configured to guide the elevation and the lowering of the button part according to the rotation of the rotating part; and a pumping guide part coupled to the pressing part to rotate together with the pressing part or rotate relative to the pressing part, configured to receive the pressure of the cap part through the guide protrusion, and configured to transfer the pressure of the cap part to the pump part, wherein according to rotation of the rotating part, the cosmetic container is changed into a first state where the button part is lowered down and the discharge part is accommodated in the rotating part or into a second state where the button part is elevated and the discharge part is exposed to outside of the rotating part.

17. The cosmetic container according to claim 16, wherein a rotation guide groove in which the guide protrusion is inserted is disposed on outer circumferential surface of the pumping guide part and the pumping guide part is rotated together with the pressing part, and wherein a tiered step is disposed on one side of the rotation guide groove to be pressed downwards by the guide protrusion when the button part is pressed.

18. The cosmetic container according to claim 17, wherein when the rotating part is rotated, the pumping guide part is rotated together with the pressing part, and when the button part is elevated, the guide protrusion gets out of the rotation guide groove and the pressing part is rotated relative to the pumping guide part, and wherein when the pressing part is rotated relatively, the guide protrusion is located at a predetermined position of one end surface of the tiered step and the pumping guide part is rotated together with the pressing part locating the tiered step in the vertical guide groove, and when the tiered step and the vertical guide groove are aligned, the pumping guide part is lowered down together with the pressing part according to the pressurization of the button part.

19. The cosmetic container according to claim 17, wherein at least one extension part extends downwards from an end portion of the pumping guide part, and a support part corresponding to the extension part protrudes inwards from inner circumferential surface of the elevation guide part, and wherein in the first state, the extension part is arranged on one end portion of the support part and is supported by the support part, and the pumping action is prevented from being carried out by the pressurization of the button part.

20. The cosmetic container according to claim 17, wherein in the second state, the contents are contained in at least a portion of the inhalation space, wherein when the second state is changed into the first state, the pressing part is lowered relative to the pumping guide part and the volume of the inhalation space is decreased, wherein the decreased volume of the inhalation space is smaller than remaining volume of the inhalation space in the second state, and wherein leak of the contents is prevented during the process that the second state is changed into the first state.

* * * * *